US011814874B2

(12) United States Patent
Stegelmann et al.

(10) Patent No.: US 11,814,874 B2
(45) Date of Patent: Nov. 14, 2023

(54) LOCKING DEVICE

(71) Applicant: Kendrion Kuhnke Automation GmbH, Malente (DE)

(72) Inventors: Jochen Stegelmann, Scharbeutz (DE); Borgar Pfeiffer, Schwentinental (DE); Lukas Nuppenau, Elmenhorst (DE)

(73) Assignee: KENDRION KUHNKE AUTOMATION GMBH, Malente (DE)

( * ) Notice: Subject to any disclaimer, the term of this patent is extended or adjusted under 35 U.S.C. 154(b) by 25 days.

(21) Appl. No.: 17/578,742

(22) Filed: Jan. 19, 2022

(65) Prior Publication Data

US 2022/0235579 A1 Jul. 28, 2022

(30) Foreign Application Priority Data

Jan. 22, 2021 (EP) ..... 21 152 964

(51) Int. Cl.
*E05B 47/00* (2006.01)
*D06F 39/14* (2006.01)
*E05B 47/02* (2006.01)

(52) U.S. Cl.
CPC ..... *E05B 47/0006* (2013.01); *D06F 39/14* (2013.01); *E05B 47/026* (2013.01); *E05B 2047/0016* (2013.01); *E05B 2047/0035* (2013.01); *E05B 2047/0073* (2013.01)

(58) Field of Classification Search
CPC ..... E05B 47/0006; E05B 47/026; E05B 2047/0016; E05B 2047/0035; E05B 2047/0073; D06F 39/14
See application file for complete search history.

(56) References Cited

U.S. PATENT DOCUMENTS 5,246,258 A * 9/1993 Kerschenbaum ... E05B 47/0002 70/279.1
7,003,993 B1 * 2/2006 Zehrung ..... H01F 7/124 292/DIG. 60
7,014,226 B1 * 3/2006 Huang ..... E05B 47/0002 292/144
9,613,766 B2 * 4/2017 Mangold ..... H01H 9/0207
(Continued)

FOREIGN PATENT DOCUMENTS

DE 603 16 237 T2 6/2008
DE 10 2012 204 490 B4 5/2017
(Continued)

OTHER PUBLICATIONS

English abstract only of EP 1 418 266 A2.
(Continued)

*Primary Examiner* — Mark A Williams
(74) *Attorney, Agent, or Firm* — Scully, Scott, Murphy & Presser, P.C.

(57) ABSTRACT

A locking device including: a locking pin movable in a linear direction; a tappet movable in the linear direction; and a clamping device connecting the tappet to the locking pin. Wherein the clamping device having an inner spring and an outer spring arranged coaxially relative to each other in the linear direction, and the inner spring is at least partially surrounded by the outer spring in a radial direction orthogonal to the linear direction.

18 Claims, 2 Drawing Sheets

(56) References Cited

U.S. PATENT DOCUMENTS

| | | | | |
|---|---|---|---|---|
| 2005/0199026 | A1* | 9/2005 | Geringer | E05B 47/0676 70/283 |
| 2008/0303290 | A1* | 12/2008 | Yuan | E05B 47/06 292/195 |
| 2010/0127518 | A1* | 5/2010 | Huang | E05B 47/0047 292/341.16 |
| 2012/0198897 | A1* | 8/2012 | Lui | E05B 47/0673 70/280 |
| 2013/0043751 | A1* | 2/2013 | Yuan | E05B 15/04 310/80 |
| 2013/0305792 | A1* | 11/2013 | Lien | E05B 47/0642 70/278.7 |
| 2016/0060904 | A1* | 3/2016 | Dore Vasudevan | E05B 47/0673 292/144 |

FOREIGN PATENT DOCUMENTS

| | | | |
|---|---|---|---|
| DE | 10 2017 128 301 | B3 | 1/2019 |
| EP | 0 439 849 | B1 | 5/1997 |
| EP | 1 826 309 | B1 | 4/2012 |
| WO | 02/16714 | A1 | 2/2002 |
| WO | 2009/113022 | A1 | 9/2009 |
| WO | 2013/131822 | A2 | 9/2013 |

OTHER PUBLICATIONS

English abstract only of EP 1 826 309 A1.
English abstract only of EP 0 439 849 A1.
English abstract only of ES 2 714 699 AA.

* cited by examiner

LOCKING DEVICE

CROSS-REFERENCE TO RELATED APPLICATION

The present application is based upon and claims the benefit to EP 21 152 964.9 filed on Jan. 22, 2021, the entire contents of each of which are incorporated herein by reference.

BACKGROUND

Field

The present disclosure relates to a locking device and more particularly to a locking device for electrical appliances, such as washing machines, having a linearly movable locking pin and a linearly movable tappet for the locking pin, wherein the tappet is connected to the locking pin by a clamping device.

The present disclosure further relates to an electrical appliance, such as a washing machine, as well as a use of a locking device.

Prior Art

Locking devices are known in the prior art, wherein locking devices are used where machine parts or system parts, for example doors or flaps, are locked in a specific position.

For example, locking devices are also used in washing machines.

A prelocking mechanism for a locking system actuated by motor and a locking system are disclosed in DE 10 2012 204 490 B4.

DE 603 16 237 T2 also discloses a device for locking the door of a washing machine.

Moreover, a lock for the door of a device having a rotary drum is disclosed in EP 1 826 309 B1. Moreover, EP 0 439 849 B1 discloses a door locking device with rapid locking and delayed unlocking, such as for a washing machine.

A generic locking device with a linearly movable locking pin and a linearly movable tappet for the locking pin is disclosed in DE 10 2017 128 301 B1, wherein the tappet is connected to the locking pin by a clamping device. In this case, the clamping device has two springs arranged in series one behind the other.

SUMMARY

An object is to provide an alternative locking device, for example for washing machines, wherein the locking device is compact and permits a reliable locking, for example for a door or flap.

Such object can be achieved by a locking device, for use in devices such as electrical appliances, such as washing machines, where the locking device having a linearly movable locking pin and a linearly movable tappet for the locking pin, wherein the tappet is connected to the locking pin by a clamping device, wherein the clamping device has two coaxially arranged springs, a first inner spring of the clamping device is at least partially surrounded by a second outer spring of the clamping device.

In the disclosed embodiments, the locking device has a clamping device having two springs which are arranged inside one another and coaxially to one another, whereby a compact arrangement of the inner (first) spring and the outer (second) spring is produced. Thus, a compact locking device is permitted. As the locking device requires little installation space, it is advantageously possible to install the locking device in multiple and optionally different appliances, such as washing machines. It is also possible to equip or, respectively, retrofit different appliances or machines with locking devices for doors or the like, by the compact locking device.

By the use of the clamping device, a linearly movable tappet and a linearly movable locking pin can be used and can be mechanically coupled together. The direction of movement of the pin-shaped or cylindrical tappet and the direction of movement of the locking pin can be collinear, such that the locking pin is linearly moved or movable, for example, by a linear movement of the tappet.

Moreover, the clamping device can be pretensioned between the tappet and the locking pin. The tappet can be configured to be pin-shaped or, respectively, cylindrical and with a circular cross section.

In the locked state of the locking device, the locking pin engages in a locking body to be locked, such as of a door lock.

One end of the tappet can be arranged, with the clamping device having the coaxially arranged springs, in a receiving chamber of the locking pin. As a result, one end of the tappet and the clamping device are positioned in the locking pin.

The first inner spring of the clamping device and the second outer spring of the clamping device can be mechanically decoupled from one another.

The first inner spring and the second outer spring can be arranged concentrically to the tappet and/or to the axis of motion of the tappet, wherein the first inner spring and the second outer spring can surround the tappet.

A sleeve-like coupling body can be arranged between the first inner spring and the second outer spring.

The first inner spring can be arranged between the tappet and the coupling body and/or the second outer spring can be arranged between the coupling body and the locking pin surrounding the tappet. A spatial separation of the first inner spring and the second outer spring can be permitted by the coupling body.

A stop can be provided in each case for the first inner spring on the tappet and on the coupling body and/or a stop can be provided in each case for the second outer spring on the coupling body and on the locking pin.

The first inner spring of the clamping device and/or the second outer spring of the clamping device can be configured in each case as a compression spring, such as a helical compression spring or a clamping spring.

The first inner spring, which can be configured as a compression spring, of the clamping device and/or the second outer spring, which can be configured as a second compression spring, of the clamping device, can be arranged on the tappet such that the spring or the springs are passed through by the tappet.

One end of the tappet for the locking pin can be at least partially received in a cavity of the locking pin.

Moreover, in one embodiment of the locking device, a drive, such as a lifting drive, can be provided for a linear movement of the tappet, wherein the drive, such as the lifting drive, can be configured as a bistable lifting magnet, such as a reversible lifting magnet.

The tappet can be (linearly) guided in the locking pin. The tappet and the locking pin can be (linearly) movable relative to one another.

Moreover, a locking body, such as a rotatable locking body can be provided, wherein the locking pin engages in the locking body in a locked position of the locking pin. The locking body can have a recess in which the locking pin engages in the locked position of the locking body. As a result, the locking body can be impeded or, respectively, fixed in terms of its movement. In the open state, the locking pin does not engage in the locking body or, respectively, in the recess of the locking body, whereby the locking body is released.

Moreover, such object can be achieved by an electrical appliance, such as a washing machine, having a closable door and having an above-described locking device for the door. In order to avoid repetition, reference is expressly made to the above embodiments.

Moreover, such object can be achieved by a use of a locking device as described above, in an electrical appliance, such as a washing machine.

BRIEF DESCRIPTION OF THE DRAWINGS

Further features of the embodiments will become apparent from the description of embodiments, together with the claims and the accompanying drawings. Embodiments may fulfil individual features or a combination of a plurality of features.

The embodiments are described hereinafter without limiting the general inventive idea by exemplary embodiments with reference to the drawings, wherein relative to all of the details, which are not described in more detail in the text, reference is expressly made to the drawings. In the drawings.

In the drawings, in each case the same or similar elements and/or parts are provided with the same reference numbers, so that in each case a repeated introduction is omitted.

DETAILED DESCRIPTION

Figure 1:
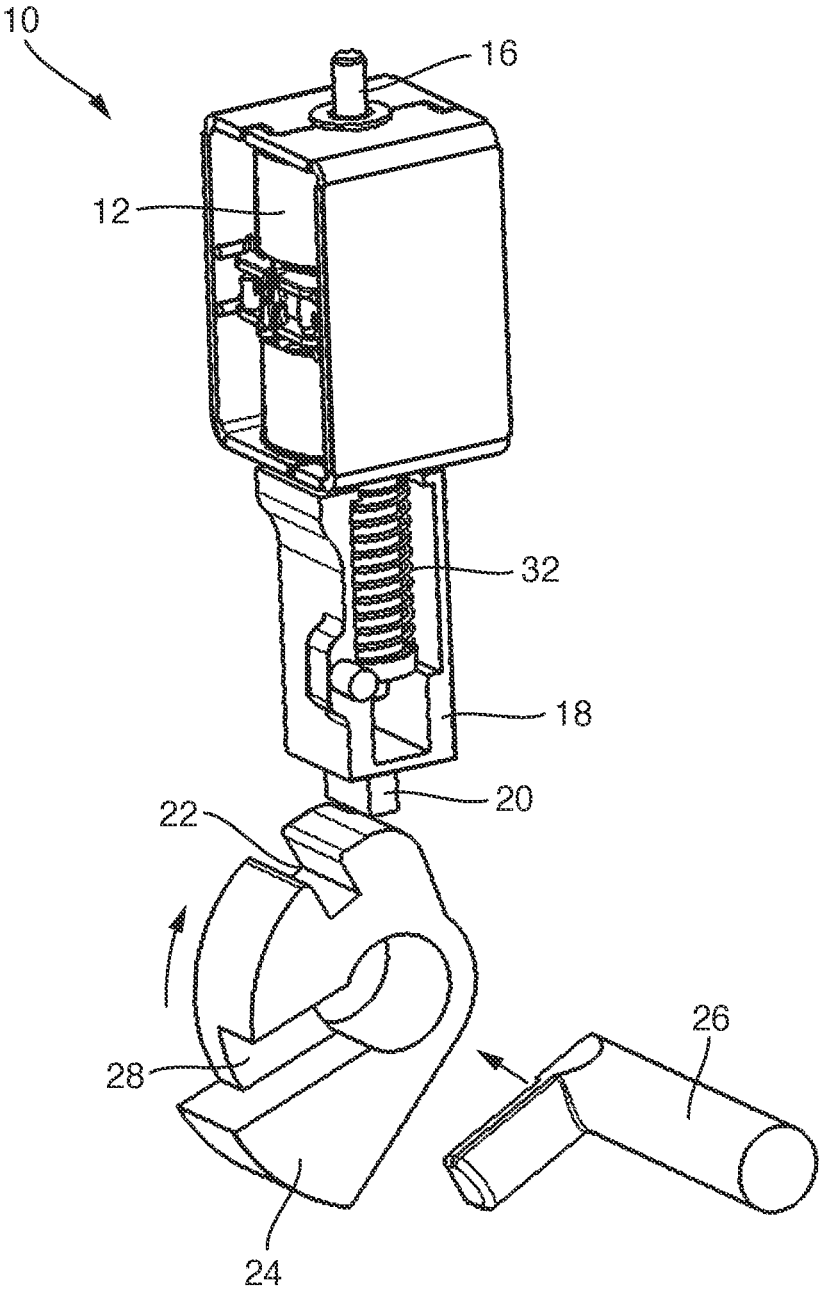
FIG. 1 illustrates schematically a perspective view of a locking device.
Figure 2:
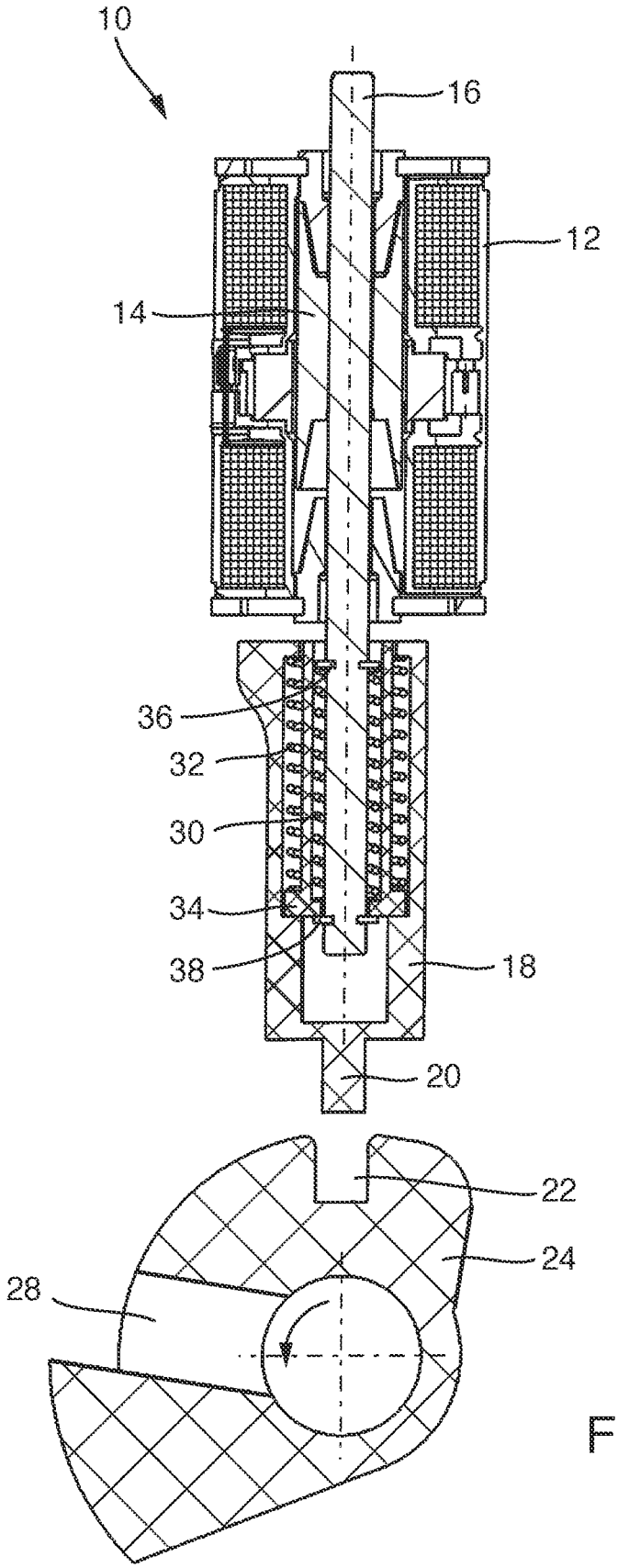
FIG. 2 illustrates schematically a cross-sectional view of a locking device in the open state.

A perspective view of a locking device 10 is shown schematically in FIG. 1. FIG. 2 shows schematically a cross section through the locking device 10 which is used, for example, for washing machines, such as for industrial washing machines.

The locking device can also be used for closing doors, flaps or the like in further electrical appliances.

The locking device 10 is arranged, for example, in a housing (not shown here). The locking device 10 has a bistable lifting magnet 12 which is used as a drive or, respectively, lifting drive for a linearly movable tappet 16. An armature 14 is arranged on the tappet 16 in the interior of the lifting magnet 12. The tappet 16 passes through the bistable lifting magnet 12, wherein when the respective end-side coils of the bistable lifting magnet 12 are energized, the tappet 16 is moved with reciprocal motion between the end positions by the armatures 14 which are movable in the lifting magnet 12. In the position of the tappet 16 or, respectively, the armature 14 shown in FIG. 2, this tappet or, respectively, armature is arranged in the upper end position thereof. The lifting magnet 12 can be configured as a reversible lifting magnet.

Outside the bistable lifting magnet 12 one end of the tappet 16 is arranged in the interior of a locking pin 18, wherein the tappet 16 is partially received in the locking pin 18. The tappet 16 is provided in this case for actuating the locking pin 18.

The locking pin 18 is configured at the end opposite the bistable lifting magnet 12 with a front-side locking stud 20 which engages in a locking groove 22 of a rotatable rotary segment 24 for locking a door hook 26 (see FIG. 1). In this case, the door hook 26 of a door (not shown here) is rotatably mounted and is introduced into a door hook receiver 28 of the rotary segment 24.

In FIG. 1 the rotary segment 24 is arranged in an unlocked position. In FIG. 2 the rotary segment 24 is arranged in a locked position.

In the interior of the locking pin 18, the end of the tappet 16 received therein is surrounded by a first compression spring 30 and a second compression spring 32, wherein the first compression spring 30 and the second compression spring 32 are coaxially arranged and the first inner compression spring 30 is surrounded by the second outer compression spring 32.

A sleeve-like coupling body 34 is arranged between the first compression spring 30 and the second compression spring 32, whereby the first compression spring 30 and the second compression spring 32 are separated from one another. The coupling body 34 is arranged between the compression springs 30 and 32, wherein the springs 30, 32 in contact with the coupling body 34, and the coupling body 34, are arranged to be linearly movable relative to the locking pin 18.

For the inner compression spring 30, an upper end-side locking ring 36 which faces the lifting magnet 12 is configured on the tappet 16 as a stop for the inner spring 30, such that the inner compression spring 30 pushes the coupling body 34 against a second locking ring 38, which is opposite the lifting magnet 12, on the tappet 16. In this case, the locking ring 38 serves as a stop for the coupling body 34. The locking pin 18 is pushed upwardly or, respectively, in the direction of the bistable lifting magnet 12 by the second compression spring 32 which is arranged between the coupling body 34 and the locking pin 18. The first compression spring 30 and the second compression spring 32 are pretensioned in each case.

The first compression spring 30 and the second compression spring 32 are coaxially arranged relative to the longitudinal axis of the tappet 16 or, respectively, the axis of motion of the tappet 16, wherein the compression springs 30, 32 are arranged inside one another. The first compression spring 30 and the second compression spring 32 form a clamping device between the linearly movable tappet 16 and the linearly movable locking pin 18, so that due to the pretensioning of the compression springs 30, 32 the tappet 16 is connected or, respectively, coupled to the locking pin 18.

In normal operation, the rotatable door hook 26 is introduced into the door hook receiver 28 of the rotary segment 24 (see FIG. 1), wherein the rotary segment 24 is subsequently rotated clockwise into a locked position until the locking groove 22 of the rotary segment 24 is arranged below the locking stud 20 of the locking pin 18 (see FIG. 2). The armature 14 is subsequently moved together with the tappet 16 out of an end position (upper position in FIG. 2) into the second end position (lower position), whereby the locking stud 20 is moved in the direction of the locking groove 22 and engages therein. As a result, the rotary segment 24 is blocked together with the door hook 26.

In the event that the rotary segment 24 is not positioned in the locked position for the locking process, as shown in FIG. 1, the locking pin 18 may be brought into a waiting position for the locking process, by the lifting magnet 12 being energized, whereby the tappet 16 is moved (downwardly), such that the first compression spring 30 is pretensioned further or, respectively, pretensioned even further. In this position, the locking pin 18 pushes against the rotary segment 24. In order to lock the rotary segment 24, said rotary segment is rotated clockwise such that due to the pretensioned first (inner) compression spring 32 the locking stud 20 of the locking pin 18 is brought into the locking groove 22 of the rotary segment 24.

When unlocking or, respectively, locking the rotary segment 24, when opening or, respectively, closing the locking device 10, the tappet 16 and the locking pin 18 are moved in the direction or, respectively, counter to the direction of the lifting magnet when the bistable lifting magnet 12 is energized, whereby the locking pin 18 is correspondingly moved due to the compression springs 30, 32 simultaneously engaging on the tappet 16.

In a locked position, in which the locking stud 20 of the locking pin 18 engages in the locking groove 22 of the rotary segment 24, and in the event that the rotary segment 24 is rotated by an external manual force against the engaging locking stud 20 such that a free linear movement of the locking pin 18 is impeded, it is possible for the tappet 16 to be moved in the direction of the lifting magnet 12 by the lifting magnet 14 being energized, whereby the second outer compression spring 32 is pretensioned (even further), wherein the locking pin 18 is held or is to be held in the locked position. If the locking of the locking pin 18 is subsequently released, the blocked locking pin 18 is linearly moved into the unlocked position by the pretensioned compression spring 32.

While there has been shown and described what is considered to be preferred embodiments, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

LIST OF REFERENCE NUMERALS

10 Locking device
12 Lifting magnet
14 Armature
16 Tappet
18 Locking pin
20 Locking stud
22 Locking groove
24 Rotary segment
26 Door hook
28 Door hook receiver
30 Spring
32 Spring
34 Coupling body
36 Locking ring
38 Locking ring

What is claimed is:

1. A locking device comprising:

a tappet having a first end drivable in a linear direction by an actuator between an extended position and a retracted position;

a locking pin engaged with a second end of the tappet to move the locking pin in the linear direction between an unlocked position and a locked position corresponding to the extended position and the retracted position, respectively; and a clamping device indirectly coupling the tappet to the locking pin;

wherein the clamping device having an inner spring and an outer spring arranged coaxially relative to each other in the linear direction, and the inner spring is at least partially surrounded by the outer spring in a radial direction orthogonal to the linear direction;

a coupling body is formed in a sleeve shape arranged between the inner spring and the outer spring in the radial direction to indirectly couple movement between the second end of the tappet and locking pin via the inner spring and the outer spring; and the outer spring is arranged between the coupling body a portion of the locking pin surrounding the second end of the tappet.

2. The locking device according to claim 1, wherein the second end of the tappet is arranged in a receiving chamber of the locking pin.

3. The locking device according to claim 1, wherein the inner spring is mechanically decoupled from the outer spring.

4. The locking device according to one of claim 1, wherein the inner spring and the outer spring are arranged concentrically to one of the tappet or to the axis of motion of the tappet.

5. The locking device according to one of claim 4, wherein the inner spring and the outer spring surround the tappet.

6. The locking device according to claim 1, wherein the inner spring is arranged between the tappet and the coupling body.

7. The locking device according to claim 1, further comprising a first stop provided on the second end of the tappet corresponding to a first end of the inner spring and a second stop provided on the coupling body corresponding to a second end of the inner spring.

8. The locking device according to claim 1, further comprising a first stop provided on the coupling body corresponding to a first end of the outer spring and a second stop provided on the second end of the locking for corresponding to a second end of the outer spring.

9. The locking device according to claim 1, wherein one or more of the inner spring and the outer spring are configured as a compression spring.

10. The locking device according to claim 9, wherein the compression spring is a helical compression spring.

11. The locking device according to claim 1, wherein the inner spring and the outer spring are arranged on the second end of the tappet such that the second end of the tappet passes through the one or more of the first spring and the second spring.

12. The locking device according to claim 1, further comprising the actuator, the actuator comprising an electromagnetic drive for moving the tappet in the linear direction.

13. The locking device according to claim 1, wherein the electromagnetic drive is configured as a bistable lifting magnet.

14. The locking device according to claim 1, wherein the tappet is linearly guided in the locking pin.

15. The locking device according to claim 1, further comprising a locking body, wherein the locking pin is configured to engage in the locking body in the locked position of the locking pin.

16. The locking device according to claim 15, wherein the locking body is rotatable.

17. An electrical appliance comprising:

the locking device according to claim 1; and a closable door configured to be locked by the locking device.

18. A method for locking an appliance, the method comprising:

driving a first end of a tappet in a linear direction between an extended position and a retracted position;

indirectly coupling a second end of the tappet to a locking pin to move the locking pin in the linear direction between an unlocked position and a locked position corresponding to the extended position and the retracted position, respectively;

wherein the coupling comprises:

providing an inner spring and an outer spring arranged coaxially relative to each other in the linear direction;

providing the inner spring to at least partially surround the outer spring in a radial direction orthogonal to the linear direction;

arranging a coupling body in a sleeve shape between the inner spring and the outer spring in the radial direction to indirectly couple movement between the second end of the tappet and locking pin via the inner spring and the outer spring; and arranging the outer spring between the coupling body a portion of the locking pin surrounding the second end of the tappet.

* * * * *